US010981190B2

(12) United States Patent
Johnson

(10) Patent No.: US 10,981,190 B2
(45) Date of Patent: Apr. 20, 2021

(54) DISPENSING PROBE FOR DISPENSING FLOWABLE MATERIAL

(71) Applicant: Liqui-Box Corporation, Richmond, VA (US)

(72) Inventor: James W. Johnson, Delaware, OH (US)

(73) Assignee: Liqui-Box Corporation, Richmond, VA (US)

( * ) Notice: Subject to any disclaimer, the term of this patent is extended or adjusted under 35 U.S.C. 154(b) by 0 days.

(21) Appl. No.: 16/503,664

(22) Filed: Jul. 5, 2019

(65) Prior Publication Data

US 2020/0009598 A1 Jan. 9, 2020

Related U.S. Application Data

(60) Provisional application No. 62/694,588, filed on Jul. 6, 2018.

(51) Int. Cl.

| | |
|---|---|
| ***B05B 15/65*** | (2018.01) |
| *B65D 77/06* | (2006.01) |
| *B65D 25/48* | (2006.01) |

(52) U.S. Cl.

CPC ..... *B05B 15/65* (2018.02); *B65D 25/48* (2013.01); *B65D 77/065* (2013.01); *B65D 77/067* (2013.01)

(58) Field of Classification Search

CPC .... B05B 15/65; B65D 77/065; B65D 77/067; B65D 25/48

See application file for complete search history.

(56) References Cited

U.S. PATENT DOCUMENTS 2,751,119 A * 6/1956 Manning, Sr. ..... B67B 7/26 222/81
4,742,851 A * 5/1988 Lundblade ..... B67D 3/045 137/614.12

(Continued)

FOREIGN PATENT DOCUMENTS

JP H10277161 A 10/1998
KR 200432560 Y1 12/2006

(Continued)

OTHER PUBLICATIONS

PCT/US2019/040670 International Search Report and Written Opinion dated Oct. 24, 2019.

*Primary Examiner* — Frederick C Nicolas
(74) *Attorney, Agent, or Firm* — McAndrews, Held & Malloy, Ltd.

(57) ABSTRACT

A probe for dispensing a flowable material includes a body having a first end and a second and a passage extending therethrough. The probe has a first engagement portion configured to have a deformed state when the first end of the body is in contact with a dispensing component, and an undeformed state. The probe has a channel having a floor and two walls and is on the first engagement portion. The probe has a second engagement portion to frictionally fit within the dispensing component and to form a seal between the probe and the component. The probe has a locking groove to prevent movement of the probe relative to the dispensing component. In the undeformed state, the walls of the channel are spaced apart at a first distance, and in the deformed state, the walls are spaced apart at a second, smaller distance.

15 Claims, 11 Drawing Sheets

(56) References Cited

U.S. PATENT DOCUMENTS

| | | | | |
|---|---|---|---|---|
| 5,141,134 | A * | 8/1992 | Machado | A47G 23/0258 222/105 |
| 7,448,418 | B1 * | 11/2008 | Tuyls | F16L 21/08 141/114 |
| 8,272,540 | B2 * | 9/2012 | Ophardt | G01F 11/025 222/321.6 |
| 9,434,516 | B2 * | 9/2016 | Johnson | B67D 3/045 |
| 2004/0178231 | A1 * | 9/2004 | Kelley | B65D 47/243 222/525 |
| 2006/0249538 | A1 * | 11/2006 | Ophardt | B05B 11/3001 222/181.3 |
| 2007/0205216 | A1 * | 9/2007 | Smith | B65D 51/226 222/81 |
| 2008/0029540 | A1 * | 2/2008 | Johnson | B67B 7/26 222/83 |
| 2010/0176151 | A1 * | 7/2010 | Johnson | B65D 77/067 222/92 |
| 2010/0176152 | A1 * | 7/2010 | Johnson | B65D 75/5877 222/92 |
| 2011/0151069 | A1 * | 6/2011 | Harding | A61J 11/0095 426/117 |
| 2011/0248054 | A1 * | 10/2011 | Darby | B65D 77/067 222/522 |
| 2013/0026190 | A1 | 1/2013 | Ophardt et al. | |
| 2015/0001261 | A1 * | 1/2015 | Johnson | B67D 3/045 222/525 |
| 2016/0362239 | A1 * | 12/2016 | Johnson | B67D 3/045 |

FOREIGN PATENT DOCUMENTS

| | | | |
|---|---|---|---|
| WO | WO 01/15769 | A1 | 3/2001 |
| WO | WO 2018/089741 | A1 | 5/2018 |

* cited by examiner

DISPENSING PROBE FOR DISPENSING FLOWABLE MATERIAL

CROSS REFERENCE TO RELATED APPLICATIONS

This application claims the benefit of U.S. Provisional Application No. 62/694,588, filed Jul. 6, 2018, the entirety of which is incorporated herein for any and all purposes.

TECHNICAL FIELD

This disclosure generally relates to a fluid transfer assembly for use with containers for flowable materials, and more particularly relates to a new design for a probe for use with a dispensing component for dispensing flowable material from a source.

BACKGROUND

Rigid or flexible containers are extensively used throughout the food service industry for storing and dispensing soft drink syrups and other such beverages, as well as wine, dairy products, enteral feeding solutions, fruit juices, tea and coffee concentrates, puddings, cheese sauces, and many other flowable materials, including those that must be filled aseptically. The containers may have inlets and/or spouts for filling and dispensing the container contents. The containers are often placed within a corrugated paper box. Such packaging systems are commonly referred to as "bag-in-box" systems wherein the spout extends through an opening in the box to dispense the contents. Bag-in-box packaging systems are often used in restaurants, institutional food service centers, and convenience stores to facilitate service of liquid food products such as syrups, toppings, condiments, beverages and dairy products. These containers typically have a capacity of 1 to 6 gallons.

The containers are connected to a dispensing mechanism, such as a spout, cap, tube, or faucet. In order to properly place the various dispensing components and containers in fluid communication together, it is necessary to connect them to prevent accidental disconnects and leaks. The dispensing mechanism must be reliable such that dispensing of the contents is achieved without wasting the dispensed materials through leakage or uncontrolled opening of the connection component and the like.

There are shortcomings with conventional connection adapters used to connect components as described above. First, existing adapters are difficult to connect and require excessive force. Furthermore, many existing options are not sufficiently secured and can be removed or reused improperly. Moreover, poor connections often lead to leaks, spills, and delays in production. Therefore, there is a need for an improved adapter probe that can be used with a container to facilitate better dispensing of the materials therein.

SUMMARY

The foregoing needs are met by the various aspects dispensing probes disclosed. A probe for dispensing a flowable material from a source includes a body having a first end and a second end opposite the first end. The body defines a passage extending therethrough between the first end and the second end. The probe further has a first engagement portion configured to have an undeformed state and a deformed state, the first engagement portion being in the deformed state when the first end of the body is in contact with a dispensing component. The probe has a channel having a floor and two walls opposite each other, the channel being disposed on the first engagement portion. The probe further has a second engagement portion configured to frictionally fit within the dispensing component and to form a seal between the probe and the dispensing component. The probe further has a locking groove configured to prevent movement of the probe relative to the dispensing component. When the first engagement portion is in the undeformed state, the two walls of the channel are spaced apart at a first distance, and when the first engagement portion is in the deformed state, the two walls are spaced apart at a second distance smaller than the first distance.

BRIEF DESCRIPTION OF THE DRAWINGS

The present application is further understood when read in conjunction with the appended drawings. For the purpose of illustrating the subject matter, there are shown in the drawings exemplary embodiments of the subject matter; however, the presently disclosed subject matter is not limited to the specific methods, devices, and systems disclosed. In the drawings.

Aspects of the disclosure will now be described in detail with reference to the drawings, wherein like reference numbers refer to like elements throughout, unless specified otherwise.

DETAILED DESCRIPTION OF ILLUSTRATIVE EMBODIMENTS

Figure 1:
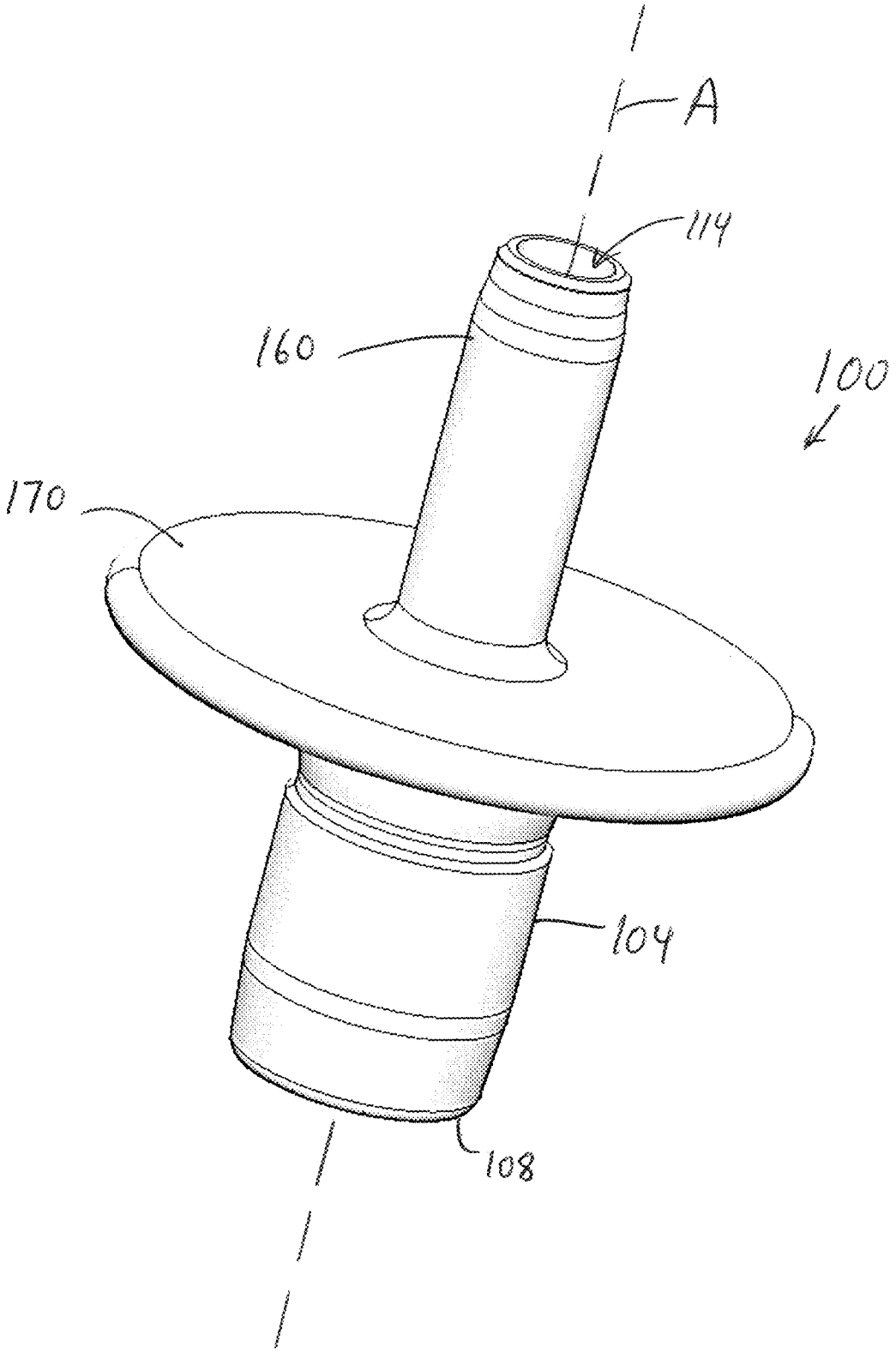
FIG. 1 depicts an isometric perspective view of a probe according to an aspect of the present disclosure.
Figure 2:
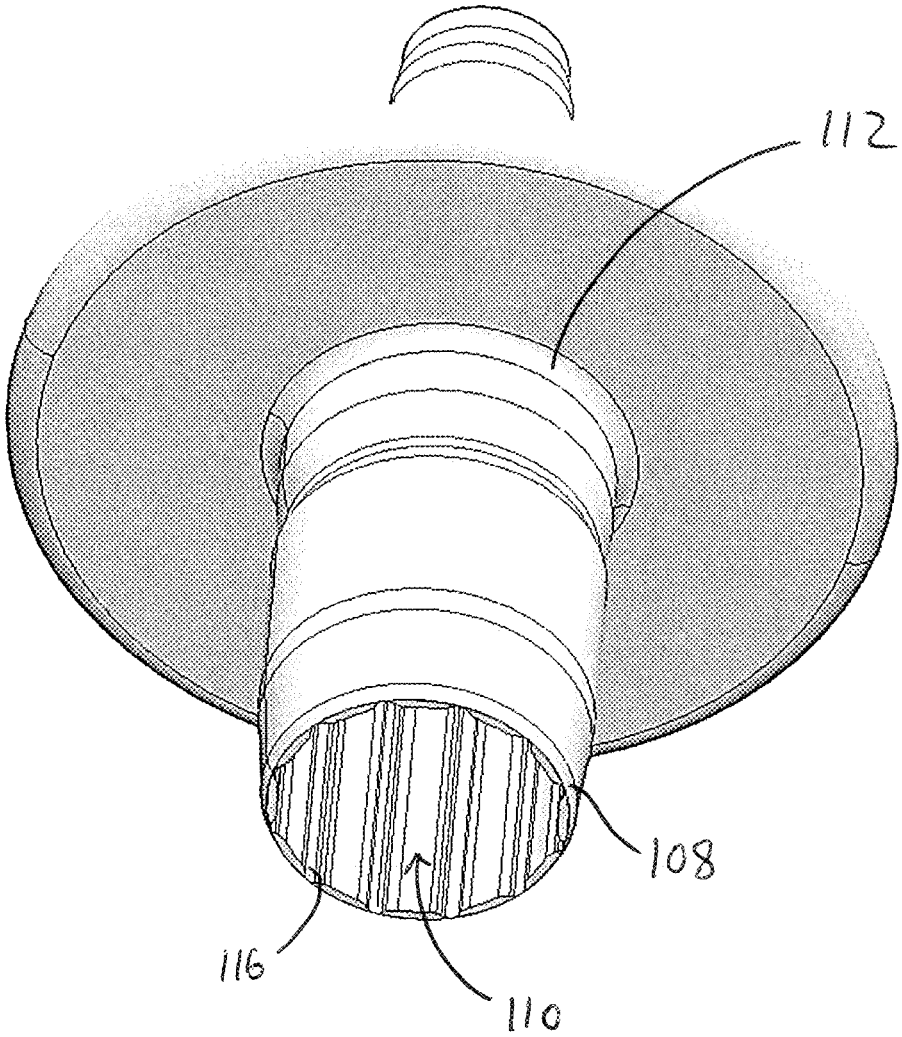
FIG. 2 depicts another isometric perspective view of the probe of FIG. 1.
Figure 3:
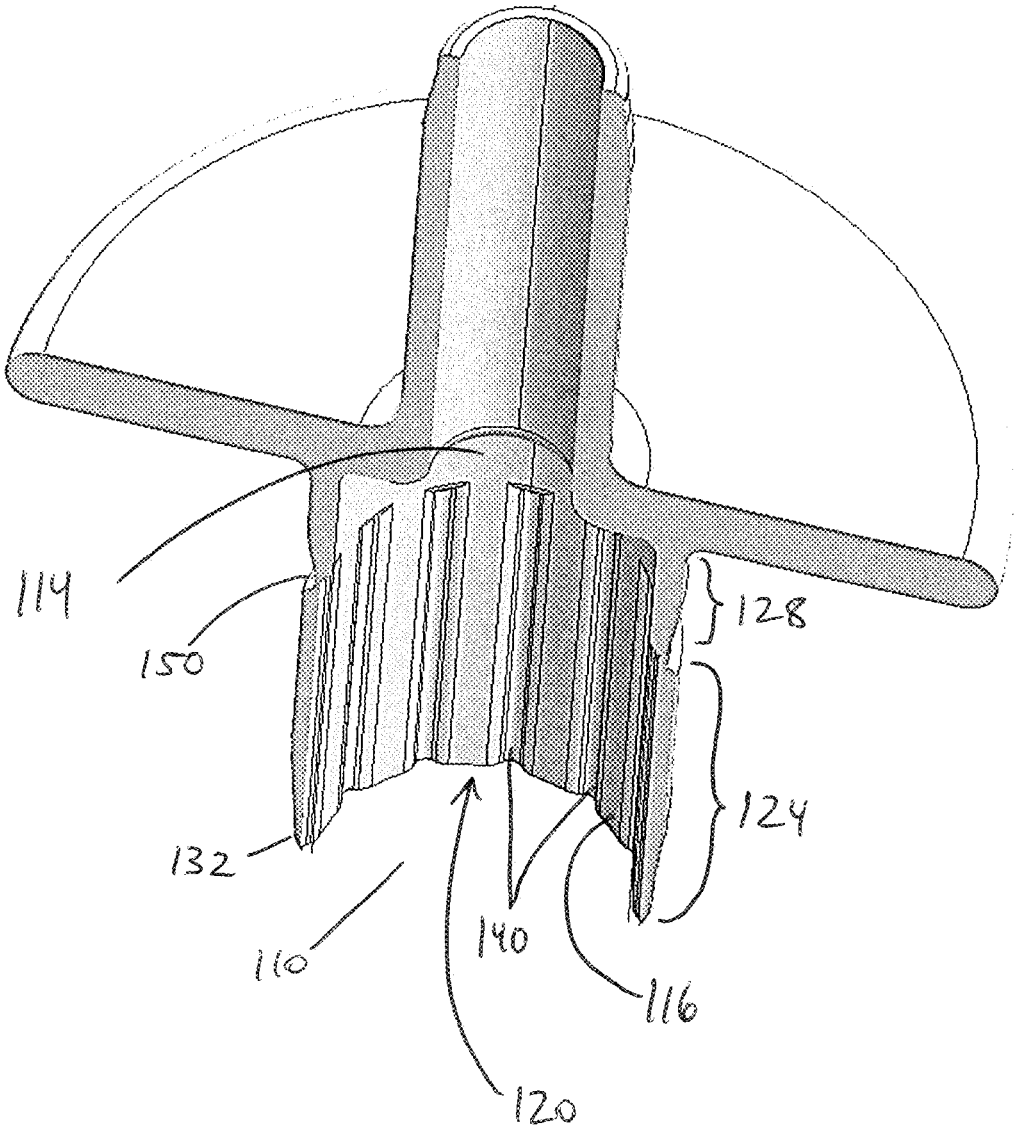
FIG. 3 depicts a cross-sectional isometric view of the probe of FIGS. 1 and 2.
Figure 4:
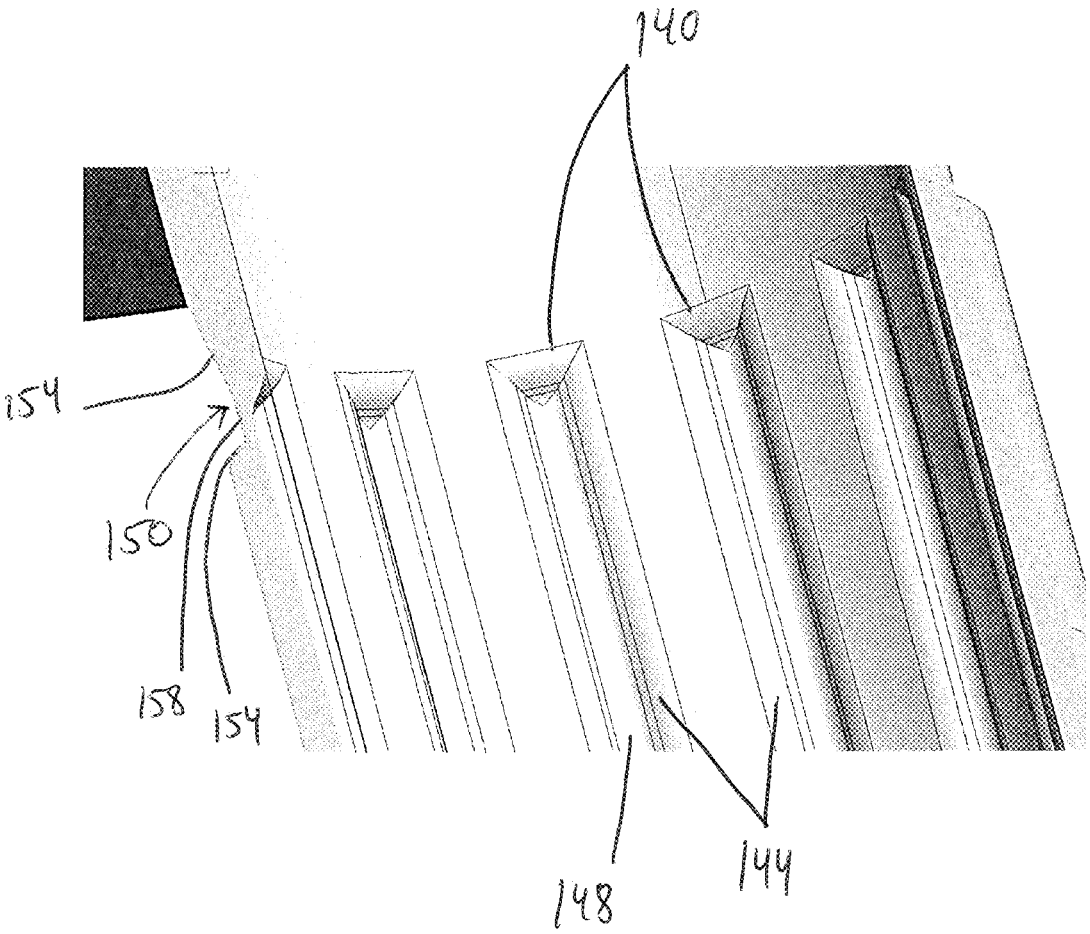
FIG. 4 depicts a close-up cross-sectional view of a portion of the probe of FIGS. 1-3.

Disclosed are aspects of probes that can be used with one or more dispensing components to connect the various dispensing components and to dispense a material therethrough. Methods of connecting and using the probes and dispensing material are also disclosed herein.

Referring to FIGS. 1-7, a probe 100 includes a body 104 that is configured to engage with a dispensing component. The body 104 may be substantially cylindrical, at least in part. The body 104 has a first end 108 and a second end 112 opposite the first end 108. The first end 108 defines a first opening 110, and the second end 112 defines a second opening 114. The body 104 is hollow and has an interior surface 116, which defines a passage 120 that extends through the body 104 between the first end 108, fluidly communicating with the first opening 110, and the second end 112, fluidly communicating with the second opening 114. The passage 120 is configured to receive the dispensing material from a source (not shown), for example, at the first end 108 through the first opening 110. The material may pass within the passage 120 through the body 104 and be dispensed through the second opening 114 at the second end 112. It will be appreciated that, in some aspects, the direction of dispensing may be reversed, such that the material enters the passage 120 at the second end 112 and passes through the body 104 and out at the first end 108. In some aspects, the first end 108 and/or the second end 112 may include one or more other dispensing components configured to receive or discharge the dispensed material.

The probe 100 can be connected to one or more dispensing components. The body 104 is shaped such that it is insertable into a dispensing component, for example, into a cap 200. It will be appreciated that the probe 100 can be used with, and connect to, a variety of dispensing components, such as caps, spouts, faucets, tubes, adapters, or other components commonly used in the dispensing field. Although exemplary aspects in this disclosure may refer to specific dispensing components, such as a cap 200, it will be understood that such examples are for illustrative purposes only, and that this disclosure is not limited to only a particular dispensing component. It will be further appreciated that the body 104 may be sized, shaped, and dimensioned in accordance with the specific desired dispensing component used, and that the probe 100 can be manufactured to various scales, shapes, and measurements.

The probe 100 may be designed to be removably or releasably coupled to the cap 200 or another dispensing component. In the context of this disclosure, a probe is designed to be removable or releasable from the dispensing component if a user can apply nominal force to disconnect the probe from the dispensing component. For example, the force can be the same or substantially similar to the force that was applied to the probe to connect the probe to the dispensing component. While it is understood that many components can physically be separated upon application of high forces, for the purposes of this disclosure, the probe 100 would not be considered "removable" or "releasable" if the user would have to apply excessive force to disconnect the probe from the dispensing component or if the user would require tools to facilitate the disconnect. The probe is also not considered "removable" or "releasable" if the probe cannot be disconnected without sustaining damage or deformation, or if the probe is otherwise unfit for use after being disconnected.

In some aspects of this disclosure, it is preferable that the probe 100 be designed to not be easily removable or releasable from the dispensing component once connected. This prevents accidental disconnection of components, which can lead to leaks or spills. In such aspects, the probe 100 is not designed or intended to be reused. Reusing probes requires proper cleaning of the probe and the related components and can require longer preparation times, delay manufacturing processes, and lead to unsanitary conditions. Easy removal and reuse could also increase risk of intentional tampering with the probe, the dispensing component, or the material being dispensed. Aspects where the probe 100 is not designed to be removable, the probe can be engaged with the dispensing component by a user, but the user cannot disengage the probe from the dispensing component without applying excessive force (for example, substantially more force than was necessary to engage the probe with the dispensing component) and/or without the use of tools.

When the probe 100 is connected to the dispensing component, for example the cap 200, the body 104 is configured to contact and engage with a complementary surface of the cap 200 to create a fluid connection between the cap 200 and the probe 100. The probe 100 may be inserted into an opening 204 of the cap 200. As the probe 100 is inserted further into the opening 204, the body 104 contacts the walls 208 that define the opening 204. The probe 100 can be inserted a predetermined distance such that the body 104 and the walls 208 create a friction fit between the probe 100 and the cap 200. The opening 204 and the passage 120 are in fluid communication, such that the dispensed material (not shown) can pass from the cap 200 into and through the probe 100.

Referring again to FIGS. 1-7, in some aspects, the body 104 defines a first engagement portion 124 and a second engagement portion 128. The first engagement portion 124 may be adjacent to the first end 108, and the second engagement portion 128 may be adjacent to the second end 112. The first and second engagement portions 124, 128 may be directly adjacent to each other or they may be separated by one or more sections of the body 104.

Referring to FIGS. 8-11, the first engagement portion 124 and the second engagement portion 128 are configured to contact the walls 208 when the probe 100 is inserted into the cap 200. The first engagement portion 124 may be more pliable or elastic than the second engagement portion 128. In some aspects, the first engagement portion 124 may have a body thickness that is smaller than the thickness of the second engagement portion 128, each thickness being measured from the exterior of the body 104 to the interior surface 116. When the probe 100 is inserted into the cap 200, the first engagement portion 124 contacts the walls 208 before the second engagement portion 128. In some aspects, a taper 132 may be defined on the first engagement portion 124, for example at the first end 108, to help orient and position the probe 100 relative to the cap opening 204.

As the probe 100 is inserted into the opening 204 (for example, along an insertion axis A), the first engagement portion 124 slidably contacts the walls 208. As the user applies more force, the probe 100 moves deeper into the opening 204. The contact between the first engagement portion 124 and the walls 208 creates a friction fit between the probe 100 and the cap 200. As the probe 100 is moved further into the cap 200, the first engagement portion 124 may deform due to the reactionary forces between the walls 208 and the body 104. In an undeformed state (i.e. when force from the walls 208 is not acting on the body 104), the first engagement portion 124 may have a first diameter, and in a deformed state (i.e. when force from the walls 208 acts on the body 104 and the body 104 is deformed), the first engagement portion 124 may have a second diameter that is smaller than the first diameter. The first and second diameters are measured in a plane orthogonal to the insertion axis A.

Figure 5:
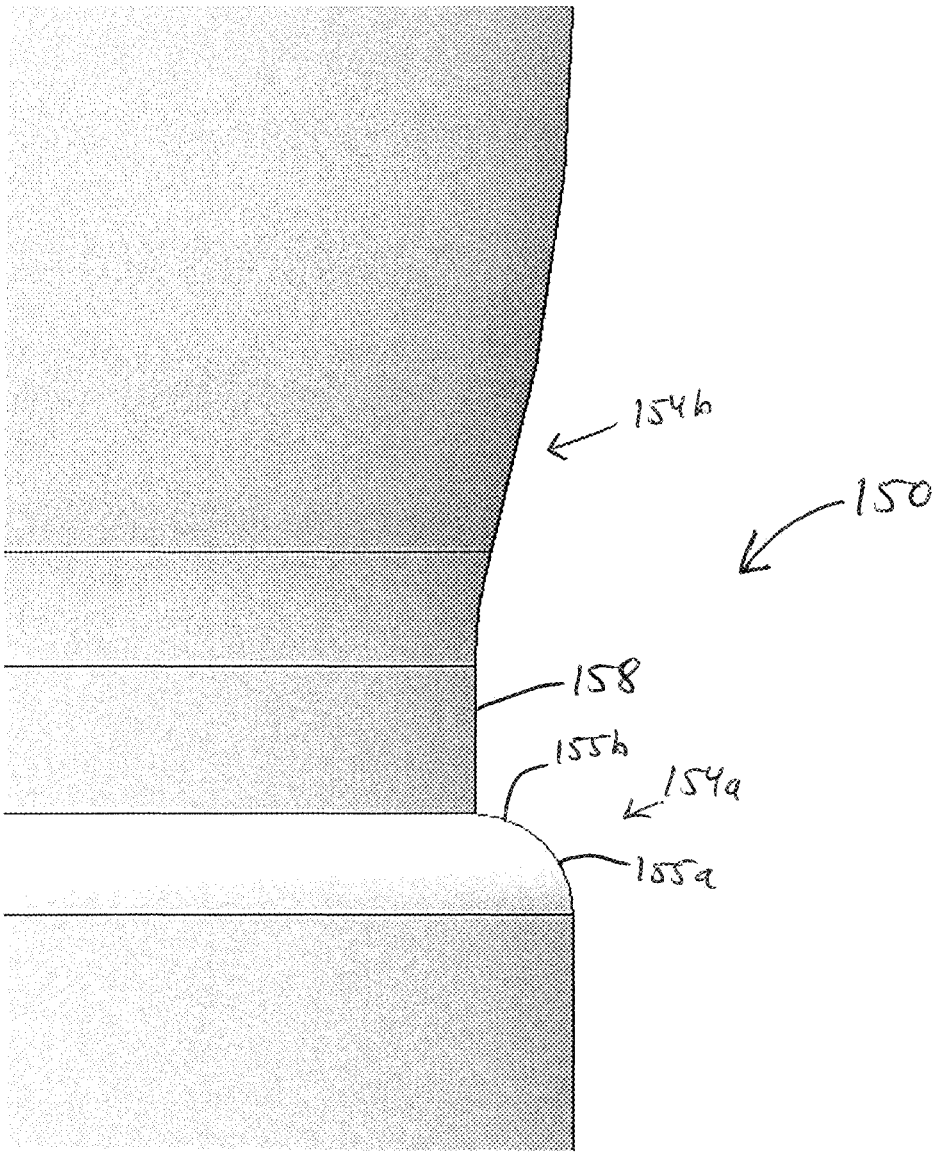
FIG. 5 depicts a front elevation view of a locking groove according to an aspect of the disclosure.
Figure 6:
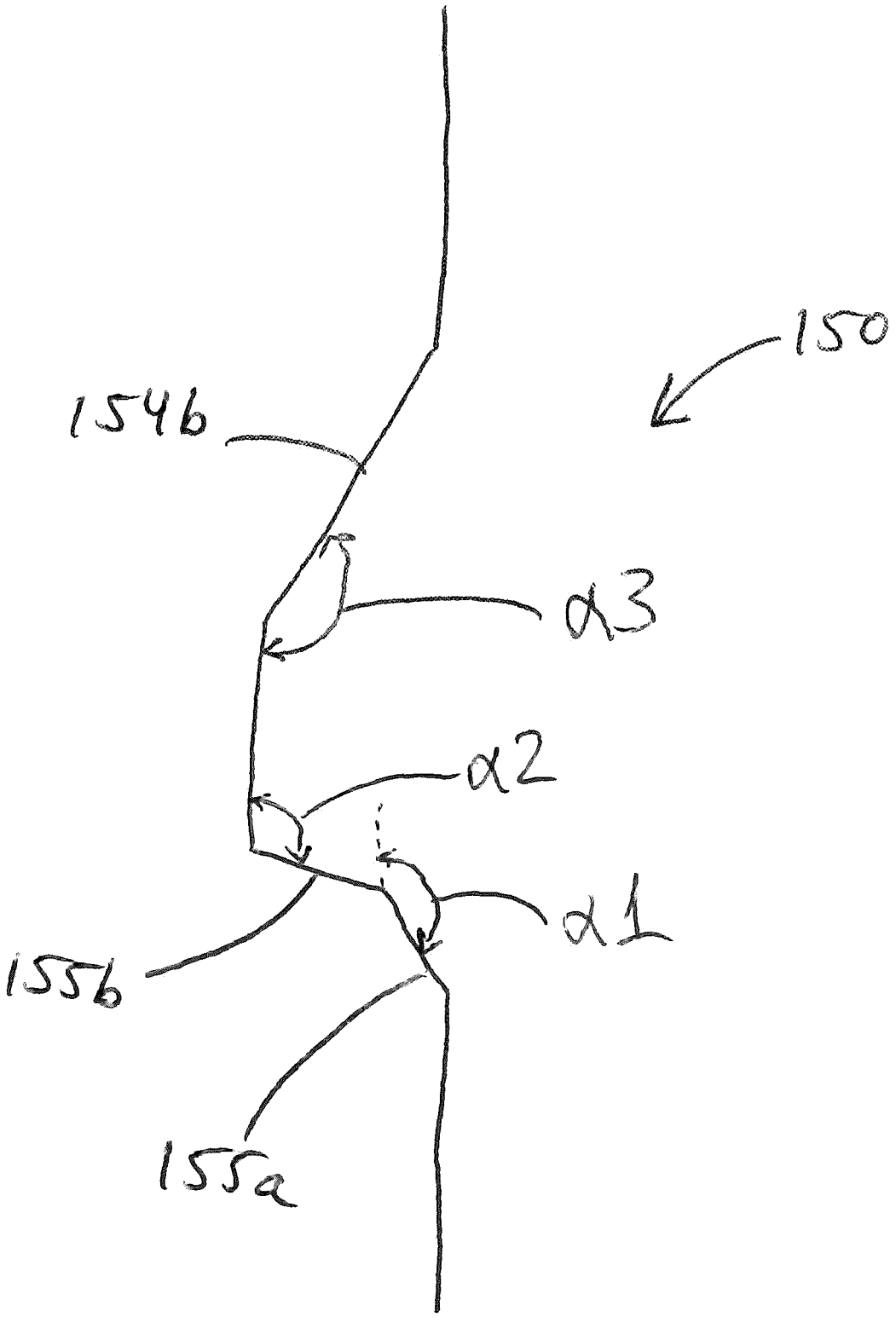
FIG. 6 depicts a front elevation view of a locking groove according to another aspect of the disclosure.
Figure 7:
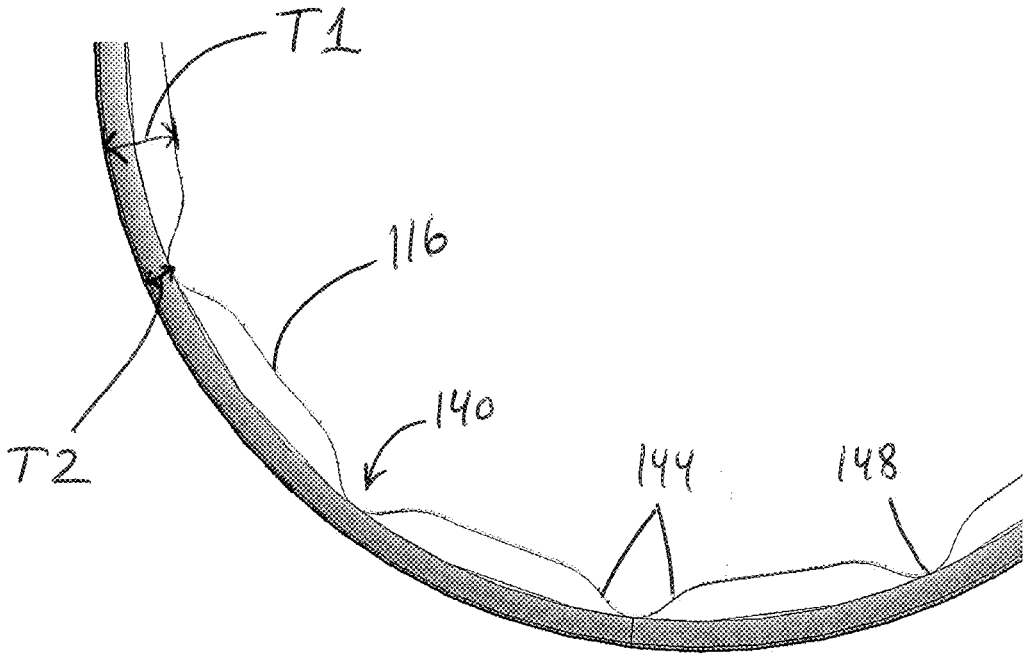
FIG. 7 depicts a cross-sectional view of a portion of a first engagement portion according to an aspect of the disclosure.
Figure 8:
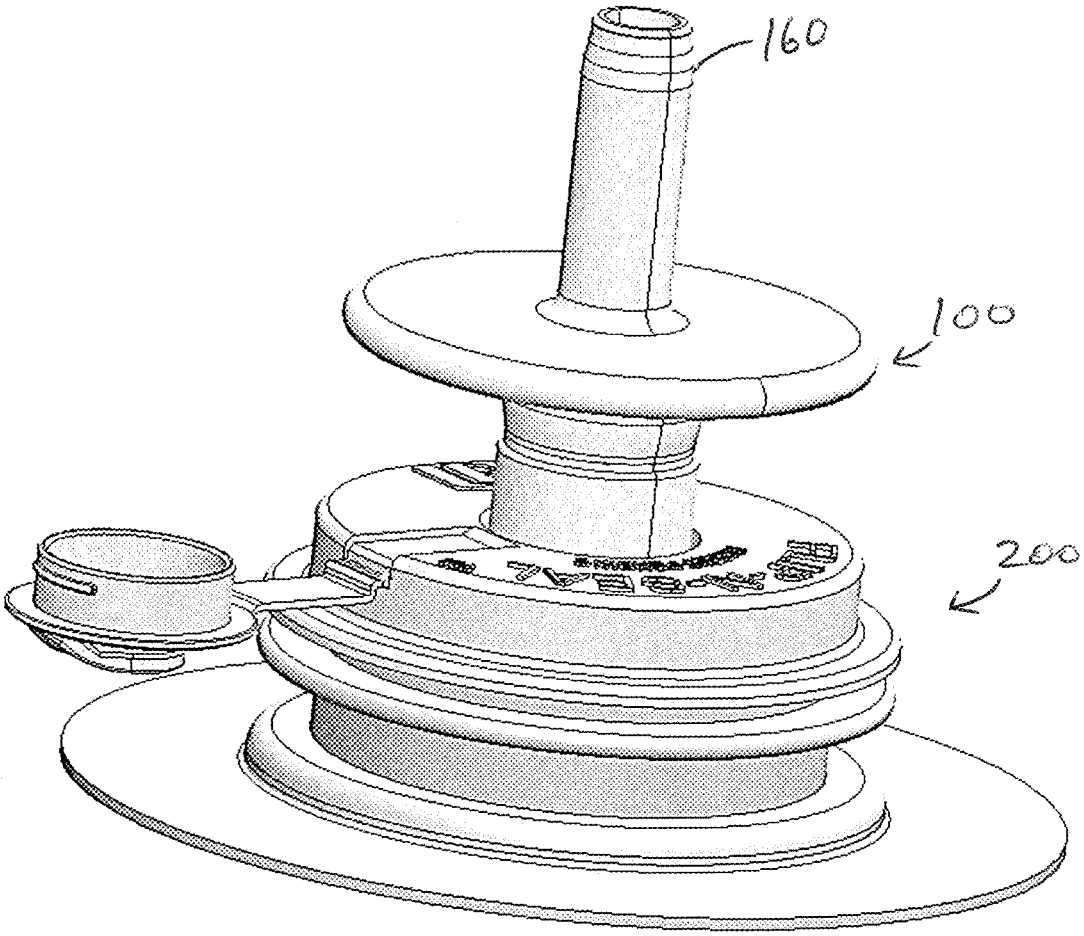
FIG. 8 depicts an assembly of a probe partly inserted into a cap according to an aspect of the disclosure.
Figure 9:
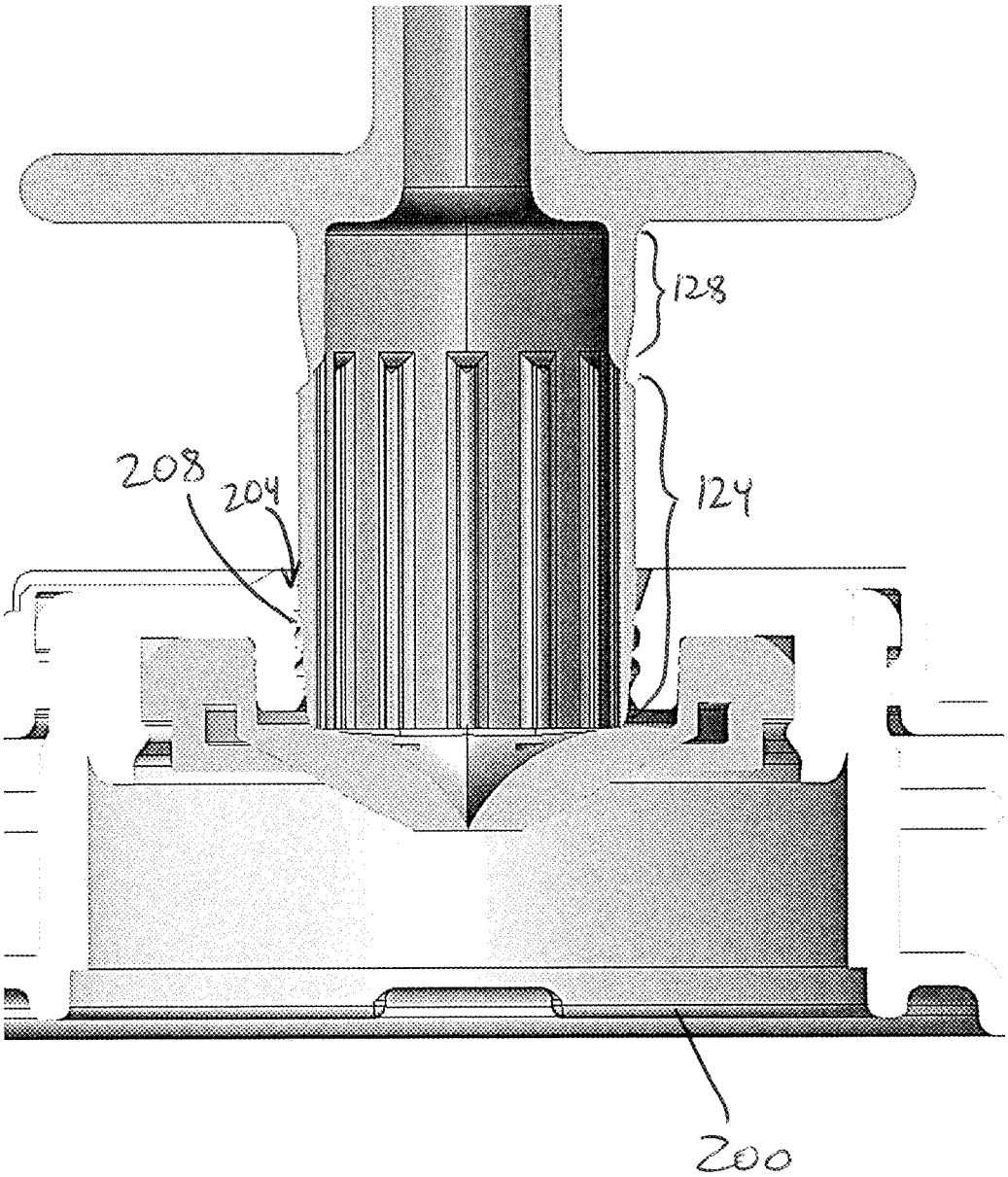
FIG. 9 depicts a cross-sectional front elevation view of the assembly of FIG. 8.
Figure 10:
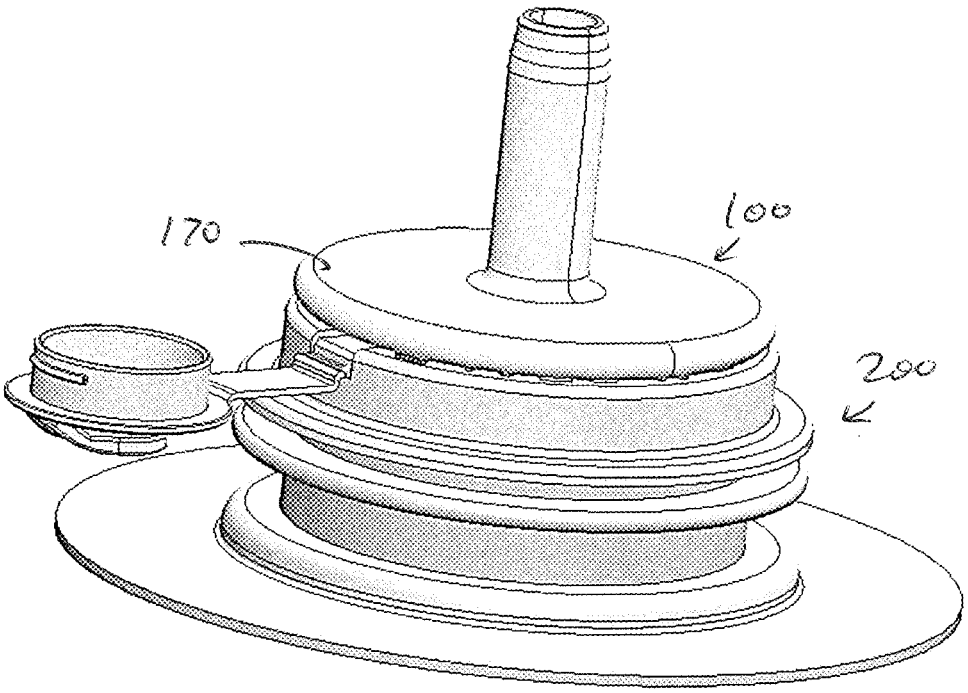
FIG. 10 depicts an assembly of a probe fully inserted into a cap according to an aspect of the disclosure.
Figure 11:
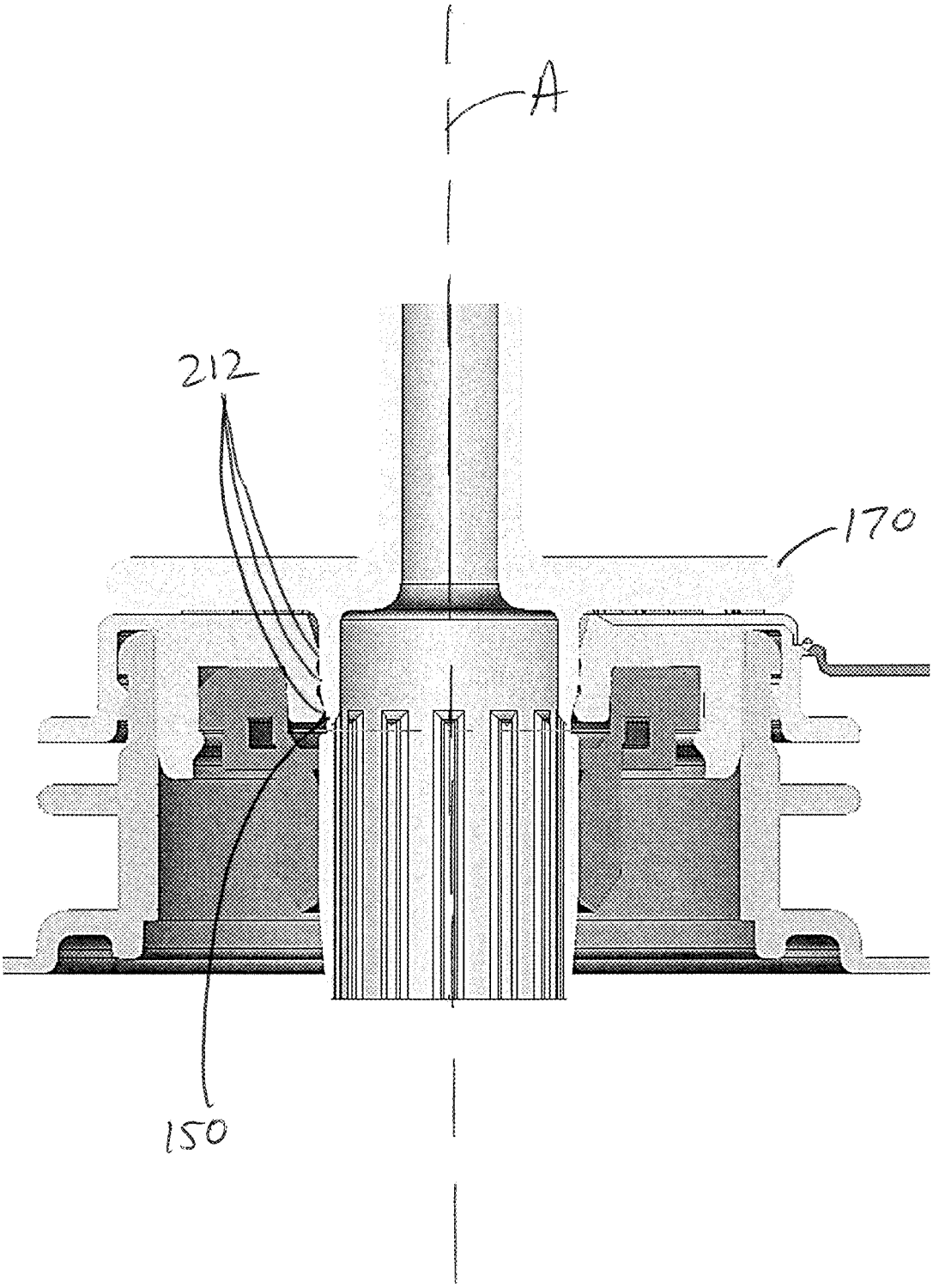
FIG. 11 depicts a cross-sectional front elevation view of the assembly of FIG. 10.

The first engagement portion 124 includes one or a plurality of channels 140 defined in the body 104. Each channel 140 has two walls 144 and a floor 148. Referring to FIGS. 1-7, each of the walls 144 may extend from the interior surface 116 toward the floor 148 in a radially outward direction away from the insertion axis A. The walls 144 may be orthogonal to the floor 148 or at a different angle between 0 and 180 degrees relative to the floor 148. The walls 144 may be linearly sloped or curved, and each wall 144 of the channel 140 may be shaped the same as the other wall or may have a different shape, slope, or dimension. The floor 148 may be flat or it may be curved. In some aspects, the floor 148 may be a single point of juncture where the two walls 144 come together (i.e. if the channel 140 is "V" shaped). The thickness of the wall of the first engagement portion 124 thus differs depending on the radial location on the body 104 it is measured. For example, as shown in FIG. 7, a first thickness T1 is measured between the interior surface 116 and the exterior of the body 104, while a second thickness T2 is measured between the floor 148 and the exterior of the body 104. The smaller second thickness T2 of the channels 140 is due to less material being present between the interior surface 116 of the body and the exterior of the body 104. This thinner portion is thus more flexible than the thicker portion having the first thickness T1, which increases flexibility of the first engagement portion 124 and allows for deformation when the probe 100 is inserted into the cap 200 and the reactionary forces from the wall 208 act on the body 104.

The first engagement portion 124 may include 1, 2, 3, . . . , 20, or another suitable number of channels 140. It will be understood that the quantity of channels 140, as well as the specific dimensions and shapes of the walls 144 and floor 148 will depend on the desired application of the probe 100, on the desired forces that it would take a user to insert the probe 100 into a dispensing component, for example into a cap 200, and on manufacturing parameters or constraints. The channels 140 are preferably sufficiently disposed such that the first engagement portion 124 is flexible enough to deform to the desired state upon insertion into the cap 200 while simultaneously being rigid enough to maintain the shape of the probe 100 without sustaining damage, such as cracking, bending, kinking, or collapsing.

The second engagement portion 128 does not have channels 140. The thickness of the body at the second engagement portion 128 may be the same or greater than the first thickness T1 of the first engagement portion 124. The cross-sectional diameter of the second engagement portion 128 (measured in a plane orthogonal to the insertion axis A) is the same as or greater than the largest diameter of the first engagement portion 124. When the probe 100 is inserted into the cap 200 and the second engagement portion 128 contacts the walls 208, the second engagement portion 128 is not designed to substantially deform to the same extent as the first engagement portion 124. As the probe 100 is moved further into the opening 204, the interaction between the second engagement portion 128 and the walls 208 creates a friction fit between the probe 100 and the cap 200. The fit at the second engagement portion 128 preferably creates a seal between the probe 100 and the cap 200 such that dispensing material cannot pass between the walls 208 of the cap and the exterior of the body 104 of the probe 100. In some aspects, the seal created between the second engagement portion 128 and the cap 200 is more fluid-tight than the seal created between the first engagement portion 124 and the cap 200. In some further aspects, the engagement created between the first engagement portion 124 and the walls 208 is not a fluid-tight seal, while the engagement between the second engagement portion 128 and the walls 208 is a fluid-tight seal. It will be appreciated that the walls 208, the opening 204, and the shape, size, dimensions, and materials of the cap 200 (or a different dispensing component being used) would be manufactured to complement the size, shape, dimensions, and materials of the probe 100 to create the necessary fit and seal.

The first engagement portion 124 and the second engagement portion 128 may be separated by a locking groove 150 that is configured to engage with one or more locking beads or ridges 212 on the cap 200 to retain the probe 100 within the cap 200. The locking groove 150 can extend radially around the body 104. In some aspects, the locking groove 150 may extend only partially around the circumference of the body 104, and the body 104 may define a plurality of locking grooves 150.

The locking groove 150 defines two walls 154 and a floor 158 between the walls 154. In some aspects, the walls 154 may have different angles and/or slopes from each other to either facilitate or prevent movement of the locking beads or ridges 212 into or out of the locking groove 150, respectively. Referring to FIGS. 5 and 6, the locking groove 150 may include a first wall 154*a* having a first wall portion 155*a* and a second wall portion 155*b* adjacent to the first wall portion 155*a*. The first wall portion 155*a* may be sloped at a first angle $\alpha 1$ relative to the floor 158, while the second wall portion 155*b* may be sloped at a second angle $\alpha 2$ relative to the floor 158 that is different from the first angle $\alpha 1$. The second angle $\alpha 2$ may be higher than the first angle $\alpha 1$, such that the second wall portion 155*b* is steeper than the first wall portion 155*a* relative to the floor 158. Such an arrangement may facilitate the locking beads or ridges 212 entering the locking groove 150 in a first direction (for example, toward the second engagement portion 128), while impeding movement of the locking beads or ridges 212 out of the locking groove 150 in a second direction opposite the first direction when the locking beads or ridges 212 are already in the locking groove 150. Thus, when the probe 100 is moved into the cap 200 and the locking beads or ridges 212 are in the locking groove 150, the probe 100 becomes difficult to disconnect and remove from the cap 200 without applying excessive force, using tools, or damaging the probe 100 or the cap 200.

In some aspects, the cap 200 may include multiple layers or sets of locking beads or ridges 212, and as the probe 100 is moved further into the opening 204 of the cap 200, one or more successive layers or sets of locking beads or ridges 212 pass, in the first direction, into the locking groove 150 and out of the locking groove 150 (also in the first direction). In such aspects, the locking groove 150 may have a differently shaped or dimensioned second wall 154*b* opposite the first wall 154*a*. the second wall 154*b* may be sloped at a third angle $\alpha 3$ relative to the floor 158. The third angle $\alpha 3$ may be lower than the first and/or second angles $\alpha 1$, $\alpha 2$, and is low enough to allow the locking beads or ridges 212 to move out of the locking groove 150 in the first direction and toward the second engagement portion 128. Multiple layers or sets of locking beads or ridges 212 can allow for different stages of insertion of the probe 100 into the cap 200 while successfully retaining the probe 100 within the opening 204 without the risk of unwanted disengagement.

The second end 112 of the probe 100 may include a connection interface 160 that is configured to attach to one or more dispensing components, such as, but not limited to, caps, spouts, faucets, tubes, adapters, or other components commonly used in the dispensing field. The probe 100 may be used as an adapter that facilitates connection between two or more components.

A flange 170 may be disposed on the probe 100. The flange 170 provides a hand-grip for pushing or pulling the probe 100. The flange 170 may also act as a physical backstop by contacting the cap 200 to prevent the probe 100 from being moved into the opening 204 beyond a desired predetermined distance.

The probe 100 can be used to dispense a variety of different materials, for example, soft drink syrups, wine, dairy products, enteral feeding solutions, fruit juices, tea and coffee concentrates, puddings, cheese sauces, condiments, and other flowable materials, including those that must be filled aseptically.

The disclosed embodiments facilitate engagement between the probe 100 and the dispensing component being connected to the probe 100. Existing devices have rigid side walls, and as the device is inserted into the dispensing component, the rigid side walls contact the respective walls of the dispensing component and removably secure the probe to the dispensing component via friction fit. However, due to the rigidity of existing devices, there are often difficulties in inserting them the desired distance into the dispensing component. The friction fit created between the existing device and the dispensing component makes it difficult to gauge how far the device should be inserted. Additionally, excessive force is often required to fully insert it, and not all users are capable of exerting the necessary force without injury or damage to the components.

In other alternative existing options, the insertable devices include a smaller diameter to ease the insertion and friction fit problems described above. However, due to the decreased diameter and less-tight friction fit, such embodiments are prone to leaking, which generates waste, requires more dispensing materials, necessitates increased costs associated with cleaning and manpower, and can cause unsafe slippery environments.

In other existing embodiments, the insertable devices can be easily removed from the dispensing component. This can lead to spills, accidental removal, or unsanitary conditions due to unintended reuse of probes. Easy removal and reuse could also increase risk of intentional tampering with the probe, the dispensing component, or the material being dispensed.

In operation, a user may prepare the dispensing component to which the probe 100 would be connected. For example, if the dispensing component is a cap 200, the cap may be opened or otherwise primed to receive a probe 100. In some aspects that require aseptic conditions, additional steps may be taken to ensure the sterility and sufficient cleanliness necessary to utilize an aseptic cap.

The probe 100 is then inserted into the opening 204 of the cap 200 with nominal force by the user. As the probe 100 is inserted and the first engaging portion 124 contacts the walls 208, the user may apply more force than the initial nominal force in order to overcome the reactionary force of the walls 208 pushing inwardly on the first engagement portion 124, as well as any existing friction forces between the probe 100 and the cap 200. During this step, the first engagement portion 124 may begin to deform, such that the channels 140 collapse and the two walls 144 of each channel 140 are moved closer to each other.

The user may continue to apply force to the probe 100 to further move it deeper into the cap 200. One or more locking beads or ridges 212 on the cap 200 slidably move along the first engagement portion 124 in a first direction (opposite the direction of insertion) until they move past the first and second wall portions 155*a*, 155*b* and enter the locking groove 150. The locking beads or ridges 212 may contact the floor 158 when in the locking groove 150.

At this stage, the user would not be able to easily reverse the insertion of the probe 100 into the cap 200 due to the locking beads or ridges 212 being within the locking groove 150. The locking beads or ridges 212 would be prevented from moving opposite the first direction by at least the second wall portion 155*b*, which would act as a physical backstop when the beads or ridges 212 contact it.

If the probe 100 is to be moved further into the cap 200, the locking beads or ridges 212 may exit the locking groove 150 by slidably moving along the second wall 154*b* that is opposite the first wall 154*a*. If another layer or set of locking beads or ridges 212 is disposed on the cap 200, this other layer or set can enter the locking groove 150 in a similar manner as the previous set did.

The user can continue to insert the probe 100 further into the cap 200 such that the second engagement portion 128 contacts the walls 208. This contact forms a tight seal that prevents any dispensing material from moving between the walls 208 and the exterior surface of the body 104. This prevents leaks or spills.

Finally, the user may connect one or more dispensing components to the probe 100 at the second end 112. Once the probe 100 is in place and any other desired components are connected, the flowable material may be moved through the probe 100 either from the first end 108 to the second end 112 or vice versa.

Optionally, when the desired dispensing actions have ceased, the user may remove the probe 100 from the cap 200. In aspects where the probe 100 is designed not to be easily removable, the user may need to apply excessive force to remove the probe 100. This may damage the probe 100, the cap 200, or another connected component, thus rendering the probe 100 not re-usable. In some aspects, it is preferred that the probe 100 not be re-usable and instead be considered "disposable" or "single use." The user may also remove the probe 100 with a specific tool (not shown).

While systems and methods have been described in connection with the various embodiments of the various figures, it will be appreciated by those skilled in the art that changes could be made to the embodiments without departing from the broad inventive concept thereof. It is understood, therefore, that this disclosure is not limited to the particular embodiments disclosed, and it is intended to cover modifications within the spirit and scope of the present disclosure as defined by the claims.

What is claimed:

1. A probe for dispensing a flowable material from a source, the probe comprising:

a body having a first end and a second end opposite the first end, the body defining a passage extending therethrough between the first end and the second end;

a first engagement portion configured to have an undeformed state and a deformed state, the first engagement portion being in the deformed state when the first end of the body is in contact with a dispensing component;

a channel having a floor and two walls opposite each other, the channel being disposed on the first engagement portion a second engagement portion configured to frictionally fit within the dispensing component and to form a seal between the probe and the dispensing component; and a locking groove configured to prevent movement of the probe relative to the dispensing component, wherein when the first engagement portion is in the undeformed state, the two walls of the channel are spaced apart at a first distance, and when the first engagement portion is in the deformed state, the two walls are spaced apart at a second distance smaller than the first distance.

2. The probe of claim 1, wherein the first end of the body is tapered.

3. The probe of claim 1, further comprising a flange extending radially from the body.

4. The probe of claim 1, further comprising a connection interface at the second end of the body, the connection interface being configured to engage with one or more dispensing components.

5. The probe of claim 1, wherein the first engagement portion and the second engagement portion are separated by the locking groove.

6. The probe of claim 1, further comprising a plurality of channels disposed radially around the first engagement portion, each channel of the plurality of channels extending between the first end of the body and the locking groove.

7. The probe of claim 1, wherein the body defines a first wall thickness at the first engagement portion having the channel and a second wall thickness at the first engagement portion not having a channel, the first wall thickness being less than the second wall thickness.

8. The probe of claim 1, wherein the body defines a third wall thickness of the second engagement portion, the third wall thickness being uniform along the entirety of the second engagement portion.

9. The probe of claim 1, wherein the locking groove has a floor, a first wall disposed at a first angle relative to the floor, and a second wall disposed opposite the first wall and at a second angle relative to the floor, the first angle being larger than the second angle.

10. The probe of claim 1, wherein the probe is a unitary piece and comprises plastic.

11. The probe of claim 1, wherein the first engagement portion has a circular cross section when in the undeformed state and a non-circular cross section when in the deformed state.

12. The probe of claim 1, wherein the second engagement portion is configured to create a fluid-tight seal when in contact with the dispensing component.

13. A method of connecting a probe to a dispensing component, the probe having a body with a first end and a second end opposite the first end and a passage extending therethrough, the probe further having a first engagement portion and a second engagement portion, the method comprises the steps of:

providing the dispensing component configured to receive the probe;

aligning the first end of the probe with the dispensing component;

moving the probe in a first direction towards the dispensing component;

contacting the dispensing component with the first engagement portion such that the first engagement portion deforms due to the contact with the dispensing component;

moving the probe in the first direction such that the second engagement portion contacts the dispensing component;

further moving the probe in the first direction such that a first locking bead on the dispensing component is moved into a locking groove defined on the probe; and further moving the probe in the first direction such that the first locking bead is moved out of the locking groove and a second locking bead is moved into the locking groove.

14. The method of claim 13, wherein the user applies a first amount of force to slidably contact the first engagement portion of the probe with the dispensing component and a second amount of force to slidably contact the second engagement portion of the probe, the first amount of force being less than the second amount of force.

15. The method of claim 13, further comprising disconnecting the probe from the dispensing component such that the probe is not suitable to be re-connected to the dispensing component.

* * * * *